United States Patent [19]

Fraden

[11] Patent Number: 5,019,804

[45] Date of Patent: May 28, 1991

[54] APPARATUS AND METHOD FOR DETECTING MOVEMENT OF AN OBJECT

[76] Inventor: Jacob Fraden, 72 Hampton Rd., Hamden, Conn. 06518

[21] Appl. No.: 335,795

[22] Filed: Apr. 10, 1989

[51] Int. Cl.[5] ..... G08B 13/26

[52] U.S. Cl. ..... 340/562; 307/308; 328/5

[58] Field of Search ..... 340/562; 324/61 R, 686; 307/125, 308; 328/5

[56] References Cited

U.S. PATENT DOCUMENTS

| | | | |
|---|---|---|---|
| 3,898,472 | 8/1975 | Long | 340/562 X |
| 3,973,208 | 8/1976 | Diamond | 340/562 X |
| 4,295,132 | 10/1981 | Burney et al. | 340/562 |
| 4,316,180 | 2/1982 | LeVert | 340/562 |
| 4,345,167 | 8/1982 | Calvin | 340/562 X |
| 4,366,473 | 12/1982 | Inoue et al. | 340/562 |

*Primary Examiner*—Glen R. Swann, III
*Assistant Examiner*—Thomas J. Mullen, Jr.
*Attorney, Agent, or Firm*—Robert A. Seemann

[57] ABSTRACT

A sensor electrode is capacitively coupled to the environment. Electric charges carried by surrounding objects induce corresponding electric charges on the sensor electrode. A high input impedance circuit senses change in charge on the electrode and provides a first varying signal indicative of that change. A second circuit compares the first signal against a threshold level and provides a second signal indicative of the movement. A pair of sensors may be included to cancel out extraneous environmental chasrges. Difference between charges on each sensor electrode of the pair is compared in a circuit which provides signal indicative of the difference. The varying signal is compared against a threshold to provide a signal indicative of the movement.

7 Claims, 2 Drawing Sheets

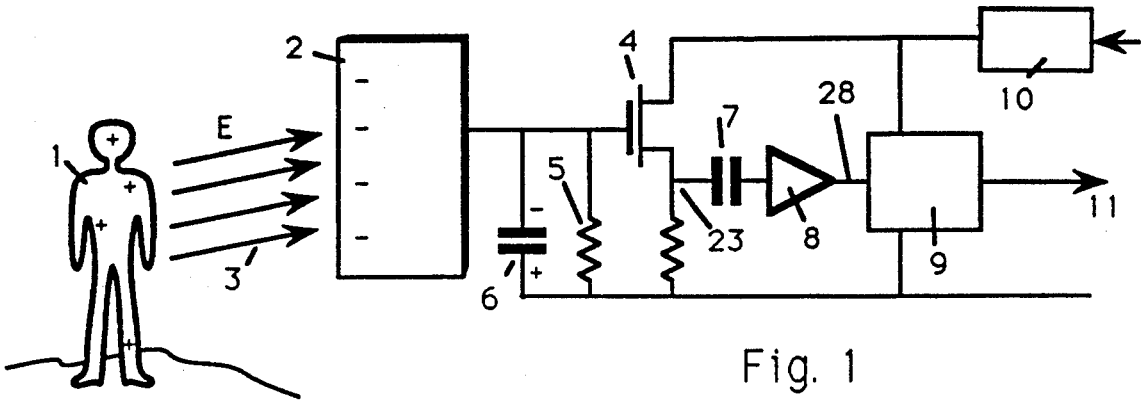
Fig. 1
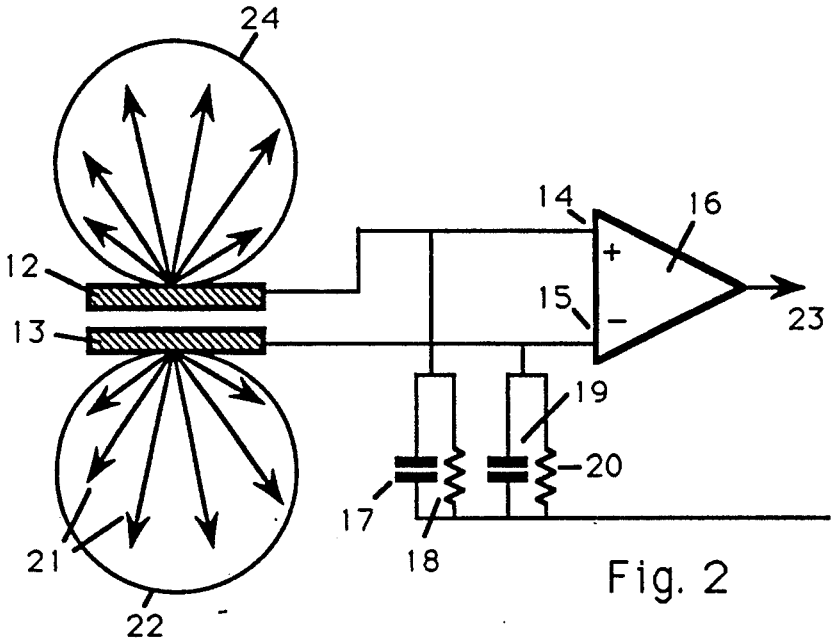
Fig. 2
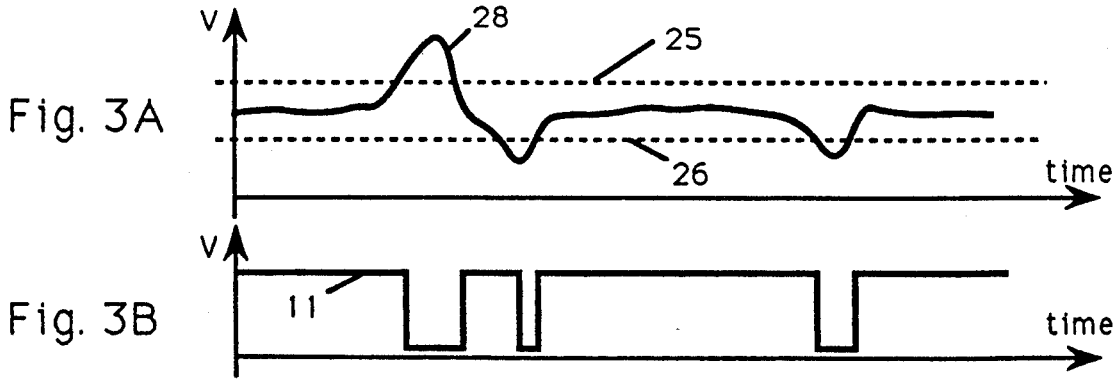
Fig. 3A
Fig. 3B

APPARATUS AND METHOD FOR DETECTING MOVEMENT OF AN OBJECT

BACKGROUND OF THE INVENTION

1. Field of the Invention

In general, this invention relates to electrical sensing and measuring, more specifically, to determining movement of objects carrying charges.

2. Description of the Prior Art

Movements of objects are detected by employing either active or passive motion detectors. Active detectors radiate test signals to the environment (like ultrasound, microwaves, infrared light, etc.) and detect either reflected signal or disturbances in the radiation pattern due to object movement. Passive detectors do not radiate any signal and detect whatever is naturally radiated by surroundings toward the sensor, like thermal radiation. The most commonly used of the latter are passive infrared (PIR) detectors. Such detectors are disclosed for instance by Schwartz (U.S. Pat. Nos. 3,760,399 and Re. 29,082), Smith et al. (U.S. Pat. No. 4,379,971), Cohen (U.S. Pat. No. 3,809,920), Fraden (U.S. Pat. No. 4,769,545) and others. Apart from many advantages, the PIR detectors have their limitations, such as reduced sensitivity when temperatures of an object and surroundings become equal or close to each other, they require focusing optical components, are sensitive to piezo-electric interference, require direct vision of an object.

Active detectors are usually large, consume substantial amount of energy, generate mutual interference and are subject to simple countermeasures. Passive detectors are more economical although their operation depends on presence in the sensor's vicinity of some kind of field related to a moving object. Thermal radiation, which is detected by PIR is one example. Another field which might be associated with a moving object is electrostatic field.

There are sensors known in the prior art which measure variable electric charges. All these sensors require use of high input impedance amplifiers as exemplified by the U.S. patents issued to Gathman et al (U.S. Pat. No. 3,644,828) and Andrus et al. (U.S. Pat. No. 4,063,154).

A variety of electrodes have been proposed to detect electrostatic field. A U.S. patent issued to Blitshteyn et al. (U.S. Pat. No. 4,529,940) teaches an application of a circumferential electrode with a rotating cylindrical chopper, while the U.S. patent issued to Polukhina et al. (U.S. Pat. No. 4,041,375) describes an areal type electrode which detects electromagnetic signals radiated from discharged static electricity.

SUMMARY OF THE INVENTION

Many objects exhibit some degree of electric conductivity. For instance, human and animal bodies contain conductive electrolytes, cars are made of metals, buildings contain metal structure elements, etc. Other objects are dielectrics, like parts of furniture, clothing, building materials, etc. Any object can accumulate electric charges on its surface. These naturally occurring charges are resulted from the triboelectric effect which is a process of charge separation due to object movements, friction of clothing fibers, air turbulence, atmosphere electricity, etc. Under idealized static conditions, an object is not charged—its bulk charge is equal to zero. In the reality, any object can exhibit some degree of its bulk charge imbalance. In other words, it becomes a carrier of electric charge.

An electronic circuit is also made of conductors and dielectrics. If the circuit is not shielded, all its components exhibit a certain capacitive coupling to the surrounding objects. In practice, the coupling capacitance is very small: on the order of 1 pf. or less. A sensor electrode can be added to the circuit to increase its coupling to the environment. It can be fabricated in a form of a conductive surface.

An electric field exists between the surrounding objects and the electrode. All distributed capacitors formed between the electronic circuit and the environmental objects are charged by the electric field. The charge magnitude depends on atmospheric conditions and nature of the objects. For instance, a person in dry man-made cloths carries millions of times higher charge than a wet swimmer who got out of a swimming pool. Under the static conditions, the electric field in the electrode vicinity is either constant or changes relatively slowly.

If an object which carries charge changes its position, moves away from an electronic circuit, or a new charge carrying object moves into vicinity of an electronic circuit, the electric field is disturbed. This results in redistribution of charges between the coupling capacitors, including those which are formed between the input or sensor electrode and the surroundings. An electronic circuit can be adapted to sense variable charges at its input. In other words, it can be made capable of converting the induced variable charges into electric signals which may be amplified and further processed. Thus, static electricity, which is a naturally occurring phenomenon, can be utilized to generate alternating signals in the electronic circuit in order to indicate movement of objects.

In accordance with a preferred embodiment of the invention, an apparatus is provided in which a sensor electrode is located so that it will be close enough to moving object, that capacitive coupling can exist between the object and the sensor electrode.

A first circuit which senses change in electric charge and which provides a varying electrical signal indicative of the change is connected to the sensor electrode for sensing change in the electrical charge on the electrode caused by the moving object.

A second circuit which compares a signal against a reference or threshold level and which provides a signal when the threshold is exceeded is connected to the first circuit for receiving the signal from the first circuit and providing an output signal that is indicative of movement of the object.

A power supply is connected to the apparatus to provide power as needed to operate the various circuits in the apparatus.

The first circuit which is preferably connected to the sensor electrode has a high input impedance and input capacitance. The input capacitance can be charged via sensor electrode in response to moving object and slowly discharged via input impedance of the first circuit.

In another preferred embodiment of the invention, a pair of sensor electrodes are located in sufficiently close proximity to the object so that capacitive coupling can exist between the object and one of the electrodes, the electrodes being so arranged with respect to one another that they are not always in equal proximity with the moving object.

A first circuit that senses change in electric charge and provides a varying electrical signal indicative of that charge is connected to one of the sensor electrodes for sensing change in electric charge of the sensor and providing an indicative first varying signal.

A second circuit, similar to the first, is connected to the second sensor of the pair for providing an indicative second varying signal.

A third circuit is connected to the first and second circuits for comparing the first varying electrical signal with the second varying electrical signal and providing a third signal indicative of a difference between the first and second signals.

A fourth circuit, connected to the third circuit, compares the third signal against a threshold level for providing a fourth signal when the threshold is passed, the fourth signal being indicative of movement of the object.

BRIEF DESCRIPTION OF THE DRAWINGS

In order that the invention be more fully comprehended, it will now be described, by way of example, with reference to the accompanying drawings, in which:

FIG. 1 is a schematic view of a charge coupled motion detector constructed according to the present invention.

FIG. 2 is a schematic view of a differential sensor electrode arrangement.

FIGS. 3A and 3B: FIG. 3A is a graph of varying electrical signal compared against a threshold level in a window comparator, and FIG. 3B is a graph of the output signal indicative of times when the threshold level signal is exceeded.

DESCRIPTION OF THE PREFERRED EMBODIMENT

Figure 4:
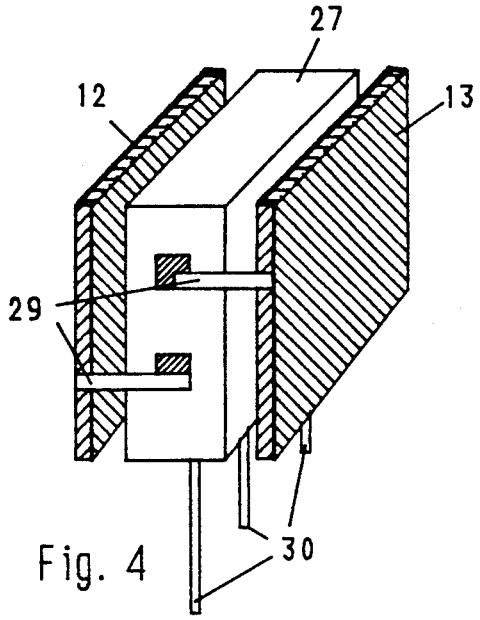
FIG. 4 is a perspective view of a motion detector with parallel sensor electrodes.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to the drawings, FIG. 1 shows a preferred arrangement of a monopolar charge coupled motion detector according to the present invention. The apparatus includes conductive sensor electrode, 2, connected to analog impedance convertor, 4, made with MOS transistor, bias resistor, 5, input capacitance, 6, coupling capacitor, 7, gain stage, 8, window comparator, 9, and power supply, 10. While rest of the electronic circuit may be shielded, the electrode, 2, is exposed to the environment. The moving object to be detected is represented by a person, 1.

Clothing is usually fabricated from either natural or man-made materials. When the person moves, parts of its dress also move resulting is localized frictions. This causes appearance of electric charges on the surface of dress and skin. Usually, air contains either positive or negative ions which can be attracted by the human body. This also changes the body's electric potential. In FIG. 1, for illustration purposes this is exemplified by positive charges distributed along the person's body. Being a charge carrier, person, 1, generates electric field, 3, having intensity, E. The field induces charges of opposite sign in the sensor electrode, 2. Under the static conditions, when the person, 1, is not moving, the field intensity, E, is constant and the input capacitance, 6, is discharged through the bias resistor, 5. That resistor must be selected of a high value: on the order of $10^9$ ohms or higher to make the circuit sensitive to relatively slow motion.

When person, 1, moves, intensity, E, of electric field, 3, changes. This results in appearance of electric voltage across the bias resistor, 5, and the varying voltage, 23, at the output of the impedance convertor, 4. Varying voltage, 23, is fed through the coupling capacitor, 7, into gain stage, 8, whose output signal, 28, is further directed to the window comparator, 9. The window comparator compares signal 28, with two thresholds, as it is illustrated in the timing diagram of FIG. 3A. One threshold, 25, is normally higher than the signal, 28, while the other threshold, 26, is lower than the signal, 28. When the person moves, signal, 28, deflects either up or down, causing comparator, 9, to generate the output signals, 11. As shown in FIG. 3B, these signals are square pulses which can be utilized and further processed by conventional data processing devices. The gain stage, 8, and a window comparator, 9, are of a conventional design and not described here in details. Generally, the thresholds, 25 and 26, should be separated sufficiently from the static level of signal, 28, to prevent false triggering from various noise sources.

There are several possible sources of interference which may cause spurious detections. Among noise sources are 60 (or 50) Hz power line signals, electromagnetic fields generated by radio stations, power electric equipment, lightnings, etc. Most of these interferences generate electric fields which are distributed around the detector quite uniformly and, can be compensated for by a symmetrical input circuit. FIG. 2 shows a differential input amplifier, 16, with a high common mode rejection ratio. The input stage must have a very high input impedance. JFET or CMOS circuits preferably should be used. Both positive, 14, and negative, 15, inputs are terminated to ground by networks similar to those of FIG. 1, consisting of resistors, and capacitors: 17, 18 and 19, 20. Two inputs of the amplifier, 16, are connected respectively to two sensor electrodes, 12 and 13. Each sensor electrode is coupled to the environment in its corresponding direction. The sensitivity patterns are represented by the curves, 22, 24 and arrows, 21. It follows from those curves, that the maximum sensitivity can be observed along the normal to the electrode surface direction. Lowest sensitivity occurs in the direction where both electrodes are equally exposed to the object.

Figure 5:
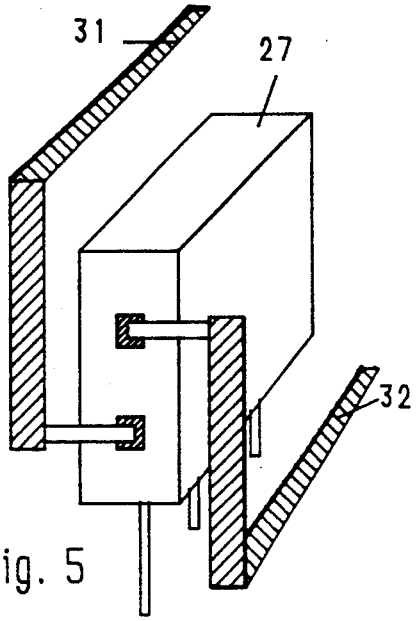
FIG. 5 is a perspective view of a motion detector with tape sensor electrodes.
Figure 6:
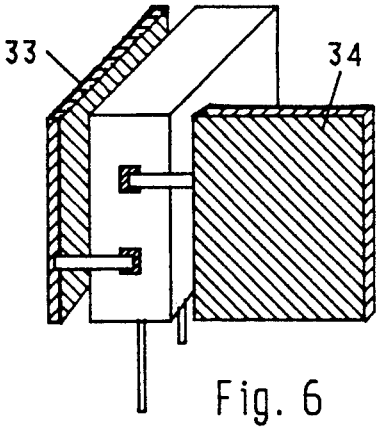
FIG. 6 is a perspective view of a motion detector with electrodes positioned at 90 degrees.
Figure 7:
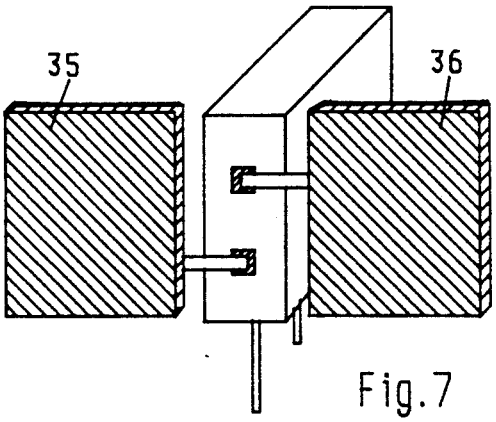
FIG. 7 is a perspective view of a motion detector with coplanar sensor electrodes.

The sensor electrode shape is an important factor in the formation of the sensitivity pattern. Depending on the actual requirements, the electrodes may be placed differently with respect to each other and to the detector. This is exemplified by FIGS. 4–7. In FIG. 4, the electrodes, 12 and 13, are positioned along the detector's housing, 27, which may be shielded to reduce possibility of spurious oscillations. It was found experimentally, that a grounded shield near the electrodes may reduce the range of the detector. A detector should be positioned in such a way as to reduce possible discharge paths between its electrode and moving objects. Use of a floating power supply and transmission of output signals via an optical or a radio wave communication channel may significantly improve sensitivity. FIG. 5 shows that sensor electrodes, 31 and 32, are shaped in the form of conductive tapes. In FIG. 6, sensor electrodes, 33 and 34, are perpendicular to each other, while in FIG. 7, the electrodes, 35 and 36, are positioned in the same plane.

Figure 8:
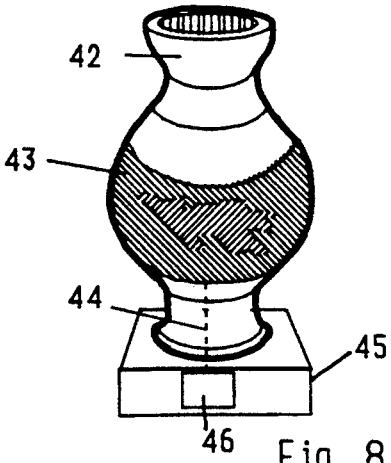
FIG. 8 is a perspective view of a motion detector with a decorative article sensor electrode.

It practice, it may be desirable to conceal the motion detector and electrodes or camouflage them for the security, aesthetics or other reasons. Since electric field can propagate through many materials, the charge coupled detector may virtually "see" through optically opaque objects. Therefore, the electrodes and the detector could be hidden inside a wall, in window or door frames. They also could be located inside book covers, file cabinets, desks, etc. The electrodes could be shaped in various forms, like wires, tapes, spheres, panels, etc. They also could take shapes of various things, like paper weights, vases, desk lamps, picture frames, toys, etc. A thin conductive coating on the surface of galss, ceramic or plastic also can function as an electrode. As an example, FIG. 8 shows a vase, 42, positioned on a base, 45. A portion of the vase surface is metallized forming an electrode, 43, which is connected to the detection circuit, 46, via a conductor, 44. Practically, any conductive media may be used as an electrode. For instance, water in a fish tank can function as an electrode if connected to a charge coupled motion detector of the present invention through an immersed conductor. If a symmetrical circuit is used, like the one shown in FIG. 2, the areas of two electrodes should be identical to assure a good interference reduction.

The charge coupled detectors can be used for the security purposes, for energy management, for toy and novelty product manufacturing and other areas where a motion detector should be concealed and where a circular field of view is desirable at relatively short distances up to 10–15 ft.

Figure 9:
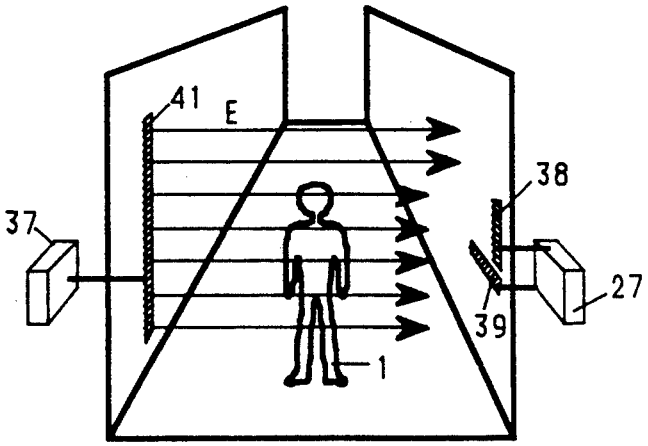
FIG. 9 is a schematic view of a motion detector apparatus which includes a charging plate.

Since a charge coupled motion detector responds to a charge carried by an object, its detecting ability may be reduced under such environmental conditions when charges are formed with a low rate. For instance, high humidity, conductive floors and wet dress may significantly diminish charge formation. To enhance the reliability of the detector and to increase its range, an active operating mode can be used. In the active mode, an additional device is required to generate electric field in the vicinity of the motion detector. FIG. 9 shows a high voltage source, 37, which is connected to the conductive element (strip), 41, positioned inside a corridor wall. The source, 37, generates high constant voltage on the order of 1,000 volts. This results in electric field, E, toward the electrodes, 38 and 39, which are connected to the detector, 27. All these components are concealed under the wall surface. When an object, 1, moves into the volume of space filled with electric field, E, its presence will disturb a charge which is induced on the electrodes, 38 and 39, causing a detection. The disturbed field is shown in FIG. 9 as shorter arrow lines.

Although the present invention has been described with respect to details of certain embodiment thereof, it is not intended that such details be limitations upon the scope of the invention. It would be obvious to those skilled in the art that various modifications and substitutions may be made without departing from the spirit and scope of the invention as set forth in the following claims.

I claim:

1. An apparatus for detecting movement of an object carrying a charge in an environment having miscellaneous varying charges, said apparatus comprising:

a pair of sensor electrodes, in sufficiently close proximity to said object so that capacitive coupling can exist between said object and one of said pair, said electrodes being so arranged with respect to each other that they are not always in simultaneous equal proximity with said moving object, a first circuit means for sensing change in electric charge and for providing a varying signal indicative of that charge, connected to a first of said sensor electrodes for sensing change in electrical charge of said first sensor electrode, and for providing an indicative first varying signal, a second circuit means for sensing change in electric charge and for providing a second varying signal indicative of that charge, connected to a second of said sensor electrodes for sensing change in electrical charge of said second sensor electrode, and for providing an indicative second varying signal, a third circuit means for comparing said first varying signal with said second varying signal and providing a third signal indicative of a difference between said first and second signals, connected to said first and second circuit means for receiving said first and second signals, a fourth circuit means for comparing said third varying signal against a threshold level and providing a fourth signal when the threshold is exceeded, connected to said third circuit means for receiving said third signal, said fourth signal being indicative of movement of said object, and power supply means, connected to said apparatus for providing sufficient power to operate the circuit means of said apparatus.

2. An apparatus according to claim 1, further comprising:

said third circuit means connected to said first and second circuit means for providing said third signal, comprising a high input impedance differential amplifier with high common mode rejection ratio.

3. An apparatus according to claim 2, further comprising:

in said first circuit means, means for said sensing of change in electric charge comprising a first capacitor connected to said first sensor electrode to develop voltage in response to change in coupled charge to the first electrode from a moving charged object, and high resistance shunt means connected to said first capacitor for slow discharge of said first capacitor, in said second circuit means, means for said sensing of change in electric charge comprising a second capacitor connected to said second sensor electrode to develop voltage in response to change in coupled charge to the second electrode from a moving charged object, and high resistance shunt means connected to said second capacitor for slow discharge of said second capacitor.

4. An apparatus according to claim 2, further comprising:

said fourth circuit means comprising a window comparator for said comparing of said third varying signal against a threshold level.

5. An apparatus according to claim 1, further comprising:

said pair of sensor elctrodes comprising pair of plates.

6. An apparatus for detecting movement of an object, said apparatus comprising:

a first charged electrode, and power supply means for charging said electrode, connected to said electrode for maintaining said electrode at a continuous charge, a second sensor electrode, in sufficiently close proximity to said first charged electrode so that said second sensor electrode can receive a charge from said first charged electrode, and said sensor electrode being arranged with respect to said charged electrode so that said moving object can affect capacitive coupling between said charged electrode and said sensor electrode for affecting the amount of charge induced in said second sensor electrode by said first charged electrode, said second electrode being connected for allowing for continuous charging of said second electrode by said first electrode, and being connected so that change in charge of the sensor is due to movement of the object, a first circuit means for sensing change in electric charge and for providing a first varying signal indicative of that change, connected to said sensor electrode for sensing change in electrical charge of said sensor electrode, a second circuit means for comparing said first varying signal against a threshold level and providing a second signal when the threshold is exceeded, connected to said first circuit means for receiving said first signal, said second signal being indicative of movement of said object, and power supply means, connected to said apparatus for providing sufficient power to operate the circuit means of said apparatus.

7. A method for detecting movement of an object carrying a charge, said method comprising:

locating a pair of sensor electrodes in sufficiently close proximity to said object so that capacitive coupling can exist between said object and at least one sensor electrode of said pair, said sensor electrodes being so arranged with respect to each other that they are not always in simultaneous equal proximity with said moving object, sensing change in electric charge on a first of said sensor electrodes and providing a first varying signal indicative of that change, and sensing change in electric charge in the second of said sensor electrodes and providing a second varying signal indicative of that change, comparing said first varying signal with said second varying signal and providing a third signal indicative of a difference between said first and second signals, and comparing said third varying signal against a threshold level and providing a fourth signal when the threshold is exceeded, said fourth signal being indicative of movement of said object.

* * * * *